United States Patent [19]

Logan

[11] 4,328,985

[45] May 11, 1982

[54] TIMING APPARATUS FOR DELAYING OPENING OF DOORS

[75] Inventor: Emanuel L. Logan, Arlington, Va.

[73] Assignee: Reliable Security Systems, Inc., Cockeysville, Md.

[21] Appl. No.: 125,995

[22] Filed: Feb. 29, 1980

Related U.S. Application Data

[63] Continuation-in-part of Ser. No. 65,491, Aug. 10, 1979, abandoned, Ser. No. 929,968, Aug. 1, 1978, and Ser. No. 57,724, Jun. 25, 1979.

[51] Int. Cl.[3] ..... E05C 15/02

[52] U.S. Cl. ..... 292/201; 292/DIG. 65; 292/92

[58] Field of Search ..... 292/144, 201, 341.16, 292/92, 21, 78, 198, 227, DIG. 65, 79, 93, 192, 209; 340/542; 70/267, 268, 270

[56] References Cited

U.S. PATENT DOCUMENTS

| | | | |
|---|---|---|---|
| 184,297 | 11/1876 | Potter | 70/267 |
| 1,989,419 | 1/1935 | Hill | 70/26 |
| 2,588,010 | 3/1952 | Kennon | 16/55 |
| 2,851,296 | 9/1958 | Guyaz | 292/78 |
| 2,881,020 | 4/1959 | Kok | 292/78 |
| 3,122,388 | 2/1964 | Powers | 292/341.16 |
| 3,309,125 | 3/1967 | Neveling | 292/78 |
| 3,383,130 | 5/1968 | DeAvila | 292/92 |
| 3,435,643 | 4/1969 | Pollak et al. | 292/216 |
| 3,583,740 | 6/1971 | Armstrong | 292/198 |
| 3,677,043 | 1/1972 | Cox | 70/92 |
| 3,970,339 | 7/1976 | Haselton et al. | 292/227 |
| 4,006,471 | 2/1977 | Pappas | 340/274 R |

FOREIGN PATENT DOCUMENTS

| | | |
|---|---|---|
| 1130325 | 5/1962 | Fed. Rep. of Germany . |
| G. 7,403,756.2 | 2/1974 | Fed. Rep. of Germany . |
| 304335 | 1/1955 | Switzerland . |

*Primary Examiner*—Richard E. Moore

*Attorney, Agent, or Firm*—Quaintance & Murphy

[57] ABSTRACT

Opening of a door, such as an emergency exit door, is delayed by encumbering a security device, such as for example a latch bolt, with the task of throttling a hydraulic fluid through a circuit, which circuit includes a normally open valve held closed by a solenoid. When the solenoid is de-energized, the circuit is opened allowing the security device to move so that the door can be opened. The solenoid is controlled by an electrical timing circuit which delays de-energization of the solenoid. The timing circuit is started by a switch mounted to be operated by movement of the latch bolt. Preferably in a situation where there are a plurality of doors, doors proximate to one another are delayed by the same electronic timing circuit. In a preferred embodiment, the electronic timing circuit is set to de-energize the solenoid at a time subsequent to the delay resulting from throttling the fluid.

31 Claims, 3 Drawing Figures

TIMING APPARATUS FOR DELAYING OPENING OF DOORS

This application is a continuation-in-part of U.S. patent application Ser. No. 065,491 filed Aug. 10, 1979, now abandoned; Ser. Nos. 929,968 filed Aug. 1, 1978, and 51,724 filed June 25, 1979.

RELATED PENDING PATENT APPLICATIONS

| APPLICATION | SERIAL NUMBER | FILED |
|---|---|---|
| EMERGENCY EXIT DOOR LATCH | 929,968 | 8/1/78 |
| EMERGENCY EXIT DOOR LOCKING AND LOCKING APPARATUS | 22,110 | 3/3/79 |
| MAGNETIC EMERGENCY EXIT DOOR LOCK SYSTEM | 051,724 | 6/25/79 |

BACKGROUND OF THE INVENTION

1. Field of the Invention

The instant invention relates to an emergency exit door lock system, and more particularly, the instant invention relates to an emergency exit door lock system wherein the system includes electrical circuitry for delaying transition of the lock from a locked mode to an unlocked mode while an alarm is sounding to give notice that the door is being opened without authorization.

2. Technical Considerations and Prior Art

As explained in the aforecited co-pending U.S. patent applications, there is a need for a new type of emergency exit door lock in which opening of the lock is delayed. In patent applications Ser. Nos. 929,968 and 022,110, the delay is accomplished by throttling a hydraulic fluid to retard retraction of a bolt while in U.S. patent application No. 051,724, the delay is accomplished by a timer which de-energizes an electromagnet after expiration of a selected time interval initiated by attempting to open the door. These approaches evolved from another approach in which a hydraulic door closure was used to effect the delay by reversing the operation of the hydraulic closure so as to delay opening the door rather than to delay closing the door. The instant invention is directed to an improvement of the aforementioned approaches.

As indicated in the related patent applications, there is an inherent conflict between safety and security, even though these two concerns are interrelated. This conflict becomes readily apparent when one considers the problems encountered in trying to optimize the design of emergency exit doors. At least some doors in public buildings, such as schools, theaters, auditoriums, restraurants and the like must, by law, be equipped with latches or locks which can be readily opened from within the building should there be a fire or other emergency situation. These locks and latches pose a security problem since doors which can be readily opened from inside of a building allow people within the building to easily escape with stolen articles and allow anyone they wish into the buildings. In the minds of security personnel, the security problems caused by easily openable emergency exit doors in many instances far outweigh the dangers of fire. Consequently, emergency exit doors are frequently locked with chains or other devices. This is done primarily because security problems arise on a day-to-day basis, whereas fires occur infrequently, and dangers of fire are therefore ignored. However, if emergency exits are locked, the results are often catastrophic when fires do occur and this, of course, causes fire departments great concern. The instant invention is an improvement over the aforementioned other approaches and helps to merge the dichotomy resulting from concerns of safety and security.

SUMMARY OF THE INVENTION

In view of the foregoing considerations, and other considerations, it is an object of the instant invention to provide a new and improved timing system for delayed opening of emergency exit door locks and/or latches.

In view of the aforementioned object, and other objects, the broad embodiment of the instant invention contemplates a door securing system which includes securing structure operating in a first mode to keep the door closed and in a second mode to allow the door to open. The shift from the first mode to the second mode is delayed by electrical circuitry which includes an electrical switch for providing a signal which indicates that an attempt to open the door is occurring and an electrical timer circuit connected to the switch for initiating the shift after a delay. The invention further contemplates including first and second timers in the electrical timer circuit. The first timer provides a trigger signal after a predetermined delay in order to indicate that a serious attempt to open the door is occurring. The second timer is started by the trigger signal of the first timer and emits a second trigger signal which permits transition of the securing structure from the first mode to the second mode. The system also includes an alarm which is sounded when an attempt is made to open the door.

In a preferred embodiment the electronic timer operates in parallel with a hydraulic delay which hydraulic delay serves as a back-up for the timer. If a plurality of doors are being protected, then one timing circuit can delay all juxtaposed doors in a door bank.

DESCRIPTION OF THE PREFERRED EMBODIMENT

Figure 1:
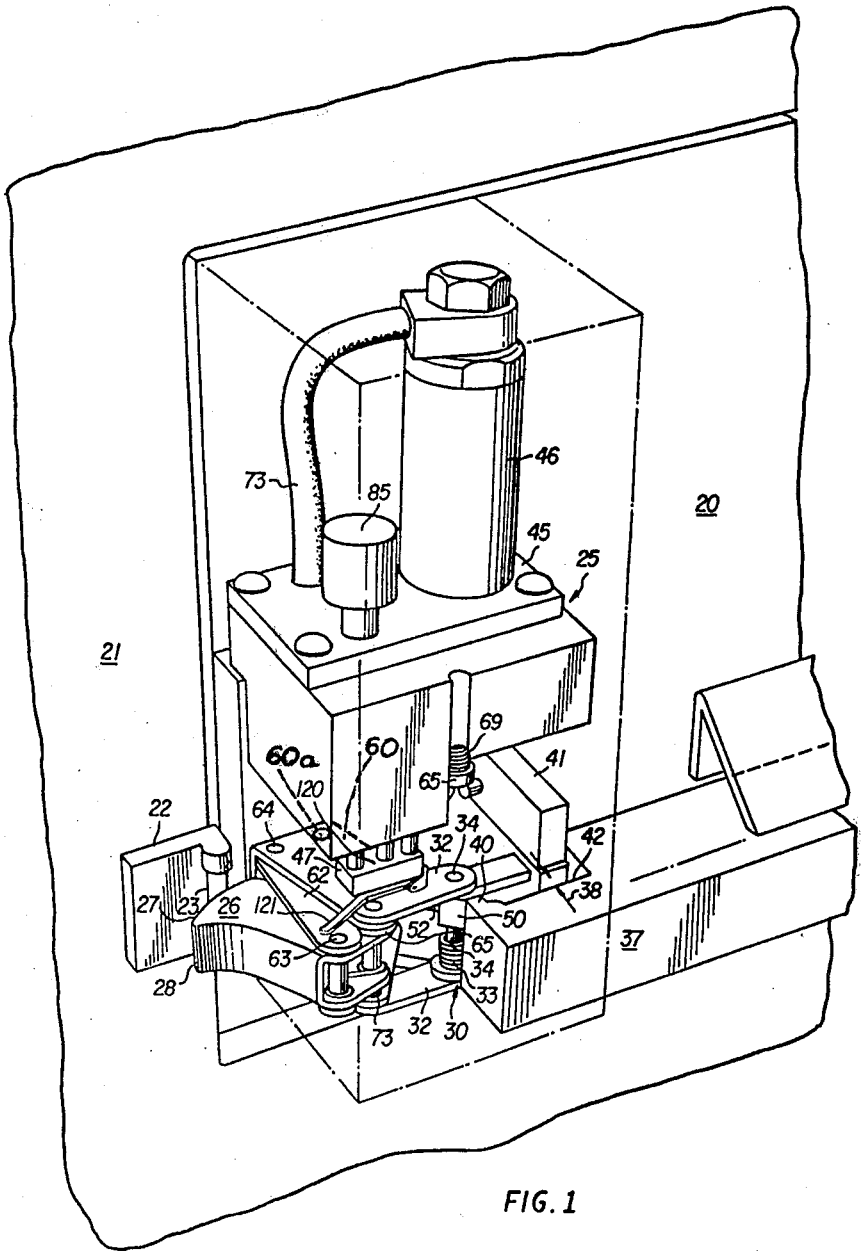
FIG. 1 is a perspective view of an emergency exit door latch mounted on a door and securing the door closed within a door frame by means of a projected bolt.

Referring now to FIG. 1, there is shown an emergency exit door 20 mounted on hinges (not shown) to pivot with respect to a door jamb 21 on which is mounted a keeper 22 having strike 23. The door 20 has a latching and locking apparatus, designated generally by the numeral 25, similar to the locking and latching apparatus disclosed in U.S. patent application entitled "Emergency Exit Door Latching and Locking Apparatus", Ser. No. 22,110, filed Mar. 3, 1979, by Roy E. VanDerLinden and incorporated herein by reference. The locking and latching apparatus 25 controls a latch bolt 26 which when projected behind strike 23, holds the door 20 latched or locked in a first mode. The bolt 26 is closure operated in that the bolt has a first cam surface 27 thereon which urges the bolt to a retracted position when in a second mode in which the apparatus is unlatched upon pressing the door 20 so as to force the first cam surface 27 against the strike 23. When the door 20 is open, the bolt 26 is projected and when the door is thereafter closed, a second cam surface 28 on the bolt 26 engages the strike 23 to urge the bolt to the retracted position so that the bolt can project behind the strike once it clears the strike. The bolt 26 is normally "dogged" in the projected positions shown in FIG. 1 by a toggle linkage designated generally by the numeral 30 which dogs the carrier link 60 upon which the bolt is mounted. The carrier link 60 is pivoted with respect to the door 20 by a pivot 60*a*. As explained in copending U.S. patent application Ser. No. 22,110, incorporated herein by reference, the bolt 26 pivots with carrier 60 upon opening the door 20 and pivots with respect to the carrier upon shutting the door. The toggle linkage 30 consists of links 31—31 and 32—32 pivotally connected to one another on a pivot pin 34 and urged by a coil spring 33, mounted coaxially on pivot pin 34 to a first position in which the bolt 26 is dogged. Upon "breaking" the toggle 30 by moving the toggle over-center toward a second position, the bolt 26 becomes undogged so that pressure on the door 20 applies the camming force to the cam surface 27 via strike 23 to thereby retract the bolt 26. The toggle 30 is broken by a push bar 37 which can move toward the door 20 by a distance 38 which is sufficient to break the toggle 30 through engaging the toggle with a projection 40 on the push bar without further pushing the toggle toward the second position in which the bolt 26 is retracted. The distance 38 is determined by a projection 41 fixed with respect to the door 10 which projection is engaged by surface 42 on the push bar 37 after the push bar 37 has been depressed to undog the bolt 26. Any force applied to the push bar 37 after the toggle linkage 30 is broken is transmitted by the projection 41 directly to the door 20 so as to cam the bolt 26 to the retracted position due to engagement between the bolt and strike 23 via surface 27 on the bolt.

Figure 2:
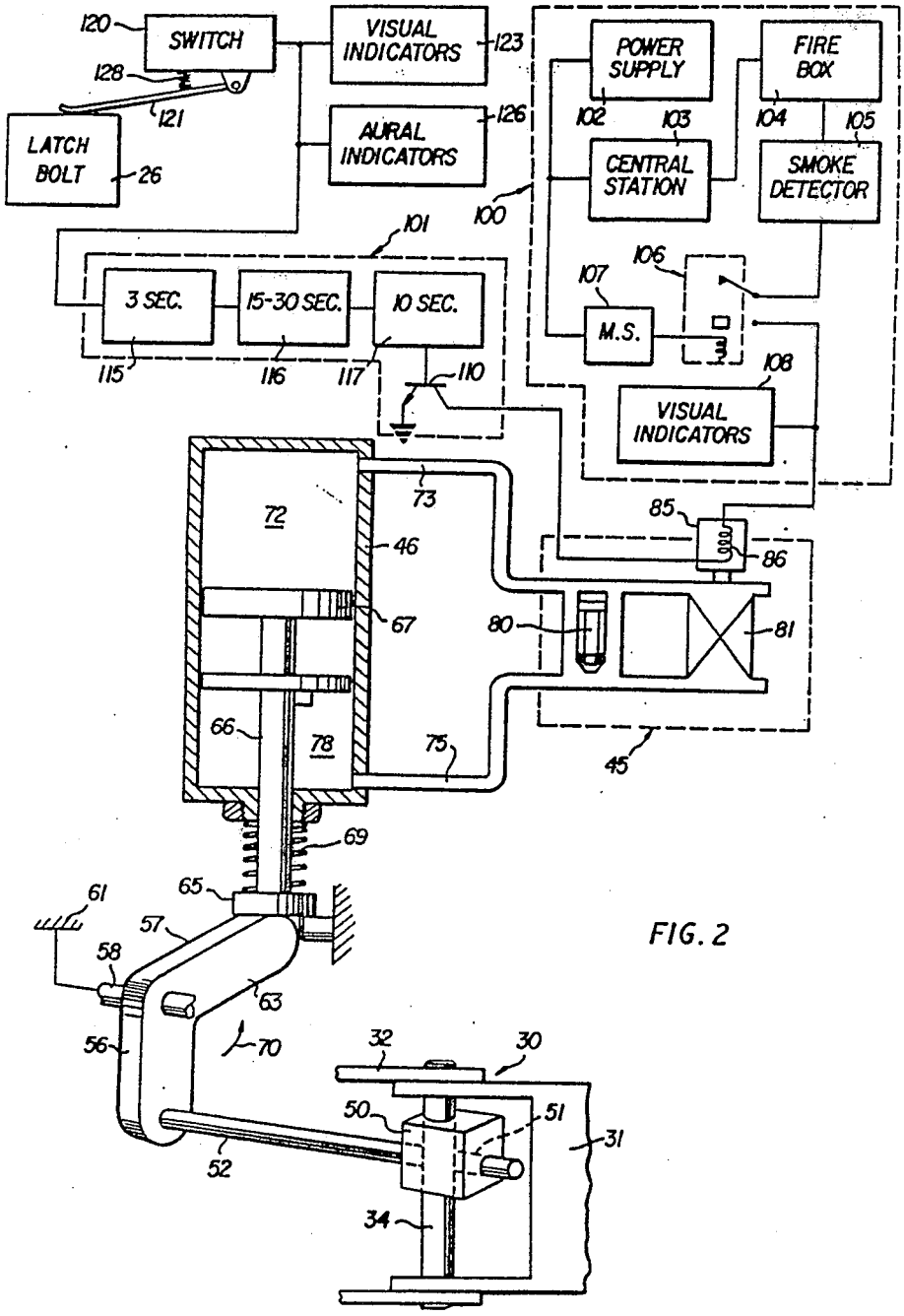
FIG. 2 is a diagrammatical view of the mechanical, hydraulic and electrical system used to delay retraction of the bolt shown in the latch of FIG. 1.

Referring now to FIG. 2 as well as FIG. 1, the force between the strike 23 and bolt 26 tending to push the bolt to its retracted position is transmitted to the toggle linkage 30 tending to collapse the toggle linkage 30 inwardly so that the pivot pin 34 moves toward the door 20. Mounted on the pivot pin 34 is a sliding block 50 which has a bore 51 therethrough which receives a rod 52. The rod 52 is rigidly connected to one arm 56 of a bell crank 57 which is mounted to pivot about a pivot 58 secured to the mounting structure 61 of the latching and locking apparatus. The bell crank 57 has a second arm 63 which engages the end 65 of a piston rod 66 which projects from a position 67 within the cylinder 46. A spring 69 urges the end 65 of the piston rod 66 against the arm 63 of bell crank 57. As the bolt retracts, the toggle linkage 30 moves inwardly toward the door 20 which causes the block 50 to both rotate on pivot pin 34 and slide upward due to a restraint on the motion of the block caused by rod 52 which is secured to the arm 56 of bell crank 57. As the block 50 moves inwardly, slides upwardly and rotates, the rod 52 causes the bell crank 57 to rotate in the counter-clockwise direction of arrow 70. Rotation of the bell crank 57 lifts the piston 67 to move hydraulic fluid within the upper part of cylinder 46 through an outlet tube 73 and into the throttling and control, hydraulic circuit 45. From the hydraulic circuit 45 the fluid returns to the lower portion 78 of the cylinder 46 via line 75.

The throttling circuit includes a check delay valve 80 and a normally open valve 81, which is held normally open by a solenoid 85. As long as the solenoid 85 is energized, the normally open valve 81 will be closed forcing the fluid through the check delay valve 80. The check delay valve 80 throttles fluid as it flows from line 73 to line 75. In the preferred embodiment, this delay is for a period of approximately thirty seconds before the door 20 opens as long as the solenoid 85 is energized to keep the valve 81 closed. When the valve 81 is opened, then fluid in line 73 will pass through the valve 81 to line 75 and allow the door to open immediately because the fluid is able to bypass the throttle 80.

The coil 86 of the solenoid 85 is connected at one end to an emergency situation, control circuit 100 and at the other end to a timing circuit 101 and when energized the coil retains the latch in the second mode. The emergency situation circuit includes a power supply 102, a central station control panel 103 (which preferably includes switches for de-energizing solenoid 85 remotely), fire boxes 104 and smoke detectors 105. These elements are connected in series with a drop-out relay 106 which includes a manual reset switch 107. If either the fire boxes 104 or smoke detector 105 indicate an emergency condition, the drop-out relay 106 will be opened to cut off power from the power supply 102 to the solenoid 85. The solenoid 85 will then allow normally open valve 81 to open so that the fluid in line 73 need not be throttled by the check delay valve 80 in order to flow to line 75 and lower chamber 78 of cylinder 46. Accordingly, the door 20 will open immediately if an emergency condition is sensed or if, for any reason, power to the solenoid 85 is interrupted. The manual reset switch 107, which can be located at the central station 103, must be operated in order to reclose the drop-out relay 106. If an emergency condition persists, then the manual reset 107 cannot reset drop-out relay 106. A visual indicator 108 in the form of a light is provided at the central station 103 and perhaps adjacent to the door 20 so as to indicate whether the door is operating in an emergency mode or in a delay mode.

The coil 86 of the solenoid 85 is attached to ground through the emitter of a transistor 110 located in timing circuit 101. Normally, the transistor 110 is switched on so as to conduct power from power supply 102 to ground. However, when the transistor 110 is switched off, the coil 86 of the solenoid 85 is no longer energized because it is in effect released by the transistor and normally open valve 81 will open shifting the lock to an openable mode. The timing circuitry 101 includes a three-to-five second timer 115 which is preferably set at five seconds; a fifteen to thirty second timer 116, which is preferably factory set, and a ten second timer 117, which is triggered by the timer 116 to turn off transistor 110 for a period of ten seconds. The timers operate in series and are connected to a microswitch 120 that is operated by an arm 121 which is pressed by spring 122 into engagement with the latch bolt 26. Upon pushing the door 20, toward the open position, the latch bolt 26 is cammed by the strike 23 toward the retracted position. After a slight movement of the bolt the arm 121 closes the microswitch 120 which starts the three-second timer 115 and which lights visual indicators 125 which may be at the central station 103 or perhaps at the door 20. The switch 120 also energizes an audio indicator or alarm 126 located adjacent the door 20 so as to indicate to the person trying to open the door and others in the vicinity of the door that the door has been tampered with. If desired, an audio indicator 126 may also be located at the central station 103.

Upon closing the switch 120, the first timer 115 is started and counts a time interval with the duration of five seconds. If the push bar 37 is released before the five second interval expires, then the timer 115 is reset and will start all over again if the bar 37 is thereafter pressed. If the bar 37 is kept pressed for five seconds then the first timer 115 triggers the second timer 116 which runs for a period of fifteen to thirty seconds, the period being determined at the factory or during installation. The timer 116 cannot be stopped or reset after being started. Upon expiration of the time interval (preferably thirty seconds) which interval is programmed into the second timer 116, the second timer generates a release signal which triggers the third timer 117 which interrupts power to the base of transistor 110 for an interval of ten seconds. When the transistor 110 is turned off, solenoid 85 will be de-energized and normally open valve 81 will open allowing the door 20 to open immediately. During this ten second interval, the door may be opened and closed without the necessity of waiting for the time sequence. Moreover, after the ten second interval has expired, the door may be held open indefinitely, but once the door is allowed to close, the timing sequence must be reinitiated.

The electronic timing system operates in parallel with the hydraulic system so as to provide a fail-safe arrangement so that if the hydraulic system does not operate the electronic system will operate, and if the electronic system 101 fails for some reason the hydraulic system will still allow the door 20 to open. It is emphasized that the combination of the hydraulic system and electrical system provides isolation between the solenoid 85 and the mechanical forces transmitted through the bolt 26 into the latching and locking apparatus 25. Accordingly, the system will not jam due to mechanical forces preventing the emergency solenoid 85 from operating. Since the solenoid 85 merely allows the normally open valve 81 to open, a system with a very quick response is achieved whereby after the selected time interval, the door 20 will open immediately.

It is to be kept in mind that the system will operate without the throttling feature of the delay check valve 80. If, for example, it is desired to have a door securing system in which the securing member does not mechanically move until after the selected or desired time interval has expired, then the fluid in the fluid circuit can be prevented from moving as long as the normally open valve 81 is closed. Immediately upon opening the valve 81, the fluid can move from one side of the piston 67 to the other, thereby allowing the door 20 to open.

In the embodiment in which the delay check valve 80 is deleted, the latch bolt 26 does not move at all after the toggle 30 is broken. Consequently, the door 20 will remain tightly shut within the door frame 21 and the width of the space between the door and door frame will not change during the delay. Depending on the design of the door 20, this can be important because if the width of the space is too great, then a fire within the building can be fed with a stream of air coming in around the door 20 during the delay.

In essence, the locking and latching apparatus 25 is one embodiment of a securing means which prevents the door 20 from opening when in a first mode and allows the door to open when in a second mode. Transition between the first and second modes is effected by expiration of the delay interval provided by the timing circuit 101; by operation of at least one of the components 103, 104 or 105 of the emergency circuit 100, or by throttling enough fluid through the check delay valve 80 to permit the bolt 26 to retract. If an abrupt change is desired after the delay, then the check delay valve 80 can be eliminated as suggested in the previous paragraph.

The securing means may also be a reversed hydraulic door check mounted to retard door openings instead of door closings, wherein the normally open valve 81 is substituted for the conventional throttle valve so that the door is released for opening immediately upon expiration of the delay period instead of gradually opening as a fluid is throttled.

Figure 3:
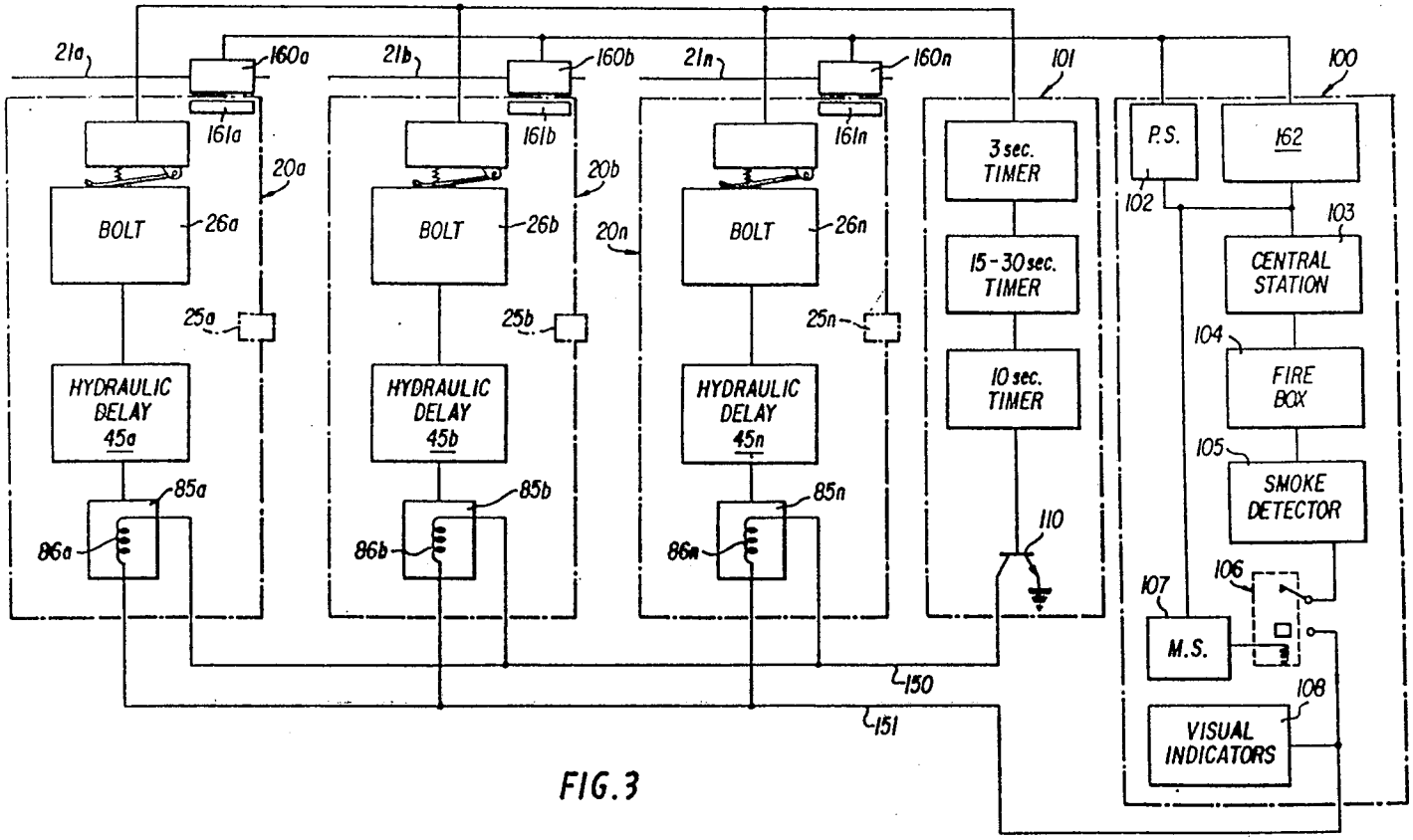
FIG. 3 is a diagrammatical view of a system which utilizes a single electronic timing system to delay the opening of a plurality of emergency exit doors.

Referring now to FIG. 3, there is shown an embodiment of the invention wherein a plurality of doors represented by numerals **20*a*–20*n* are connected to a single timing circuit 101 and a single emergency situation control circuit 100. The doors 20*a*–20*n* are each equipped with a separate securing means or latch 25*a*–25*n* such as the latch 25 shown in FIG. 1. Each of the latches 25*a*–25*n* includes the hydraulic circuit 45 shown in FIG. 2 which is opened by a normally open valve 81 held closed by solenoid 85 upon energizing the coil 86** in the solenoid.

In FIG. 3, coils **86*a*–86*n* of solenoids 85*a*–85*n* are in parallel across line 150 from the collector of transistor 110 and line 151 connected to the emergency situation control circuit 100. Accordingly, when the transistor 110 interrupts current from the power supply 102, which is preferably located in the circuitry 100, all of the doors 20*a*–20*n* are allowed to open although only one of the switches 120*a*–120*n* has been activated. Consequently, if the doors 20*a*–20*n* are arranged in banks of perhaps 5 to 20 doors at one location in a building, then all of the doors will be released simultaneously upon pressing the emergency operating bar 37** of only one door.

It should be kept in mind that all of the doors **20*a*–20*n* remain latched even when the latches are in a quick opening mode and then, after the ten-second reset time, the doors are again secured. Each of the doors 20*a*–20*n* in the bank is individually openable after the time interval determined by its own hydraulic delay circuit 45. Consequently, the redundancy or override feature in the embodiment of FIG. 2 is also provided in the embodiment of FIG. 3**.

While the emergency situation control circuit 100 is shown operating one bank of doors in FIG. 3, it should be kept in mind that the same emergency circuitry can be used to operate numerous banks of doors, if necessary or desired. If, for some reason, individual banks of doors or groups of individual banks of doors need separate emergency situation control circuits 100, then separate circuits can be provided. To a large extent, this depends on the configuration and need of the building in which the system is employed.

As with the arrangement of FIG. 1 for a single door, the electronic timing circuitry 101 can be set for a relatively short delay of perhaps 15 to 30 seconds after a serious attempt to open the door is indicated by one of the switches **120*a*–120*n* while the hydraulic delay circuitry 145*a*–145*n*** can be set with a delay interval which is perhaps 15 seconds longer.

In monitoring the condition of the doors **20*a*–20*n* or even of a single door, it is necessary to provide a separate indicator explaining whether each door is open or closed. This cannot be determined by the position of the bolt 25 since, if the door is open and the bolt is projected, the switches 120***a*–120*n* indicate to a remote station that the door is secure.

The conditions of the doors 20*a*–20*n* are monitored by magnetic reed switches 160*a*–160*n* mounted in the door jambs 21*a*–21*n* within which the doors are mounted. Permanent magnets 161*a*–161*n* are mounted within the edges of the doors 20*a*–20*n* to keep the magnetic reed switches closed. When one of the doors 20*a*–20*n* is opened, the associated magnetic reed switch is opened which activates remote indicator 162*a*–162*n* at the security station. The indicators 162*a*–162*n* can have both visual and audible signals.

The foregoing is merely illustrative of the invention which is to be limited only by the following claims.

What is claimed:

1. A system for securing at least one emergency exit door of an enclosure while providing for emergency opening of the emergency exit door to provide egress from the enclosure, the system comprising:

securing means for preventing the door from opening when a securing means is in a first mode; and for allowing the door to open when the securing means is in the second mode;

retaining means included with the securing means for retaining the securing means in the first mode;

releasing means connected to the retaining means and operating the retaining means for allowing the securing means to shift to the second mode;

electrical switch means for providing a signal indicating that an attempt to open the door is occurring;

electrical timing means connected to the electrical switch means and started by the signal from the electrical switch means to generate a release signal after a predetermined time interval, the electrical timing means being connected to the releasing means to thereby allow the securing means to shift from the first mode to the second mode; and means for indicating that an attempt has been made to open the door.

2. The system of claim 1 wherein the securing means includes a bolt means and keeper means wherein the bolt means is projected behind the keeper means when the securing means is in the first mode and retractable from behind the keeper means when the securing means is in the second mode;

and wherein the electrical switch means includes:

operating means connecting the switch means to the bolt means.

3. The system of claim 2 further comprising throttling means for throttling a fluid, means for connecting the bolt means to the throttling means for delaying retraction of the bolt means upon an attempt to open the door, a valve means included with the retaining means, the throttling means being in parallel with the valve means, the valve means being opened by the releasing means whereby the valve means allows the fluid to bypass the throttling means upon generation of the release signal by the electrical timing means.

4. The system of claim 3 wherein the bolt means includes a cam surface for engaging the keeper means and mounting means for mounting the bolt means to retract upon application of a force between the bolt means and keeper means whereby the bolt means is retracted upon pressing against the door.

5. The system of claim 4 further including a toggle linkage connected to the bolt means and movable over center from a first configuration to a second configuration wherein when in the first configuration, the toggle linkage is blocked from collapsing thereby dogging the bolt means and preventing the bolt means from collapsing and when in the second configuration, the toggle linkage is not blocked from collapsing thereby undogging the bolt means and allowing the bolt means to retract.

6. The system of claim 5 including a panic bar extending across the door and having means thereon for engaging the toggle linkage to push the toggle linkage toward the second configuration whereby the toggle linkage collapses, and wherein the releasing means further includes abutment means for transferring force directly to the door after the toggle linkage has collapsed whereby pressure on the panic bar causes the keeper to urge the bolt means toward the retracted position.

7. The system of claim 1 further including means on the door for indicating whether the door is open or shut, wherein the securing means includes bolt means and wherein the electrical switch means includes means for monitoring the position of the bolt means to determine whether the bolt means is projected or retracted.

8. The system of claim 1 for securing a plurality of doors wherein each of the doors includes at least securing means and retaining means thereon, and wherein at least the timing means is displaced from the doors in a single circuit wherein a single timing circuit delays the shifting of the securing means on a plurality of doors from the first to the second mode.

9. The system of claim 8 further including on each of the doors means for indicating whether the doors are open or shut, wherein the securing means each include bolt means and separate electrical switch means for each bolt means, which switch means each include means for monitoring the position of the bolt means to determine whether the bolt means are projected or retracted.

10. The system of claim 1 wherein the electrical timing means includes:

a first timer connected to the electrical switch means for providing an initiating signal after a predetermined delay in order to indicate that a serious attempt to open the door is occurring, and a second timer started by the signal of the first timer for emitting the release signal after a second predetermined interval.

11. The system of claim 10 wherein the first timer includes means for delaying the initiating signal for approximately three seconds, and the second timer includes means for delaying the release signal for approximately fifteen to thirty seconds.

12. The system of claim 10 wherein the timing means further includes:

a third timer connected to the second timer and to the retaining means for holding the securing means in the second mode for a predetermined interval and for thereafter permitting the securing means to return to the first mode.

13. The system of claim 12 wherein the first timer includes means for delaying the initiating signal for approximately three seconds, the second timer includes means for delaying the release signal for approximately fifteen to thirty seconds, and the third timer includes means for holding the securing means in the second mode for approximately ten seconds.

14. The system of claim 1 wherein the electrical timing means includes a timer for holding the securing means in the second mode for a predetermined interval after the release signal is generated and for thereafter permitting the securing means to return to the first mode.

15. In combination with an emergency exit door, a system for securing the door, the combination comprising:

securing means for preventing the door from opening when said securing means is in a first mode and for allowing the door to open when said securing means is in a second mode;

means for retaining the securing means in a first mode;

means connected to the retaining means for delaying for a time interval transition of the securing means from the first to the second mode;

means for initiating the time interval upon an attempt to open the door;

means for effecting an abrupt change from the first mode to the second mode upon expiration of the time interval;

means for indicating an attempt has been made to open the door, and emergency signalling means for indicating the occurrence of an emergency condition, said emergency signalling means being connected to the retaining means for operating the retaining means to allow shift of the securing means from the first to the second mode upon the occurrence of an emergency condition.

16. The system of claim 15 wherein the securing means includes a latch bolt and a hydraulic circuit having a cylinder with a piston therein, the piston being attached to and driven by the latch bolt and wherein the means for effecting the abrupt change from the first mode to the second mode includes a valve disposed in the circuit and a solenoid connected to the valve for allowing abrupt opening of the valve upon expiration of the time delay.

17. An emergency exit door securing system wherein the system is used to secure a door member with respect to a door jamb member, the system comprising:

a latch including a bolt on one member and a keeper on the other member wherein the bolt projects between the members for securing one to the other;

means for mounting the bolt for retraction upon pressing on the door member;

fluid stop means, including a piston, a cylinder and normally open valve means for releasing fluid pressurized in the cylinder by the piston;

means for connecting the bolt to the fluid stop means for pressurizing fluid in the cylinder upon pushing on the door;

a solenoid for holding the normally open valve means closed when the solenoid is energized;

power supply means for applying current to the solenoid to energize the solenoid;

electrical timing means connected between the solenoid and power supply;

means operated by the electrical timing means for interrupting current to the solenoid after a time interval determined by the electrical timing means;

means for detecting when an attempt is made to open the door, said detecting means being connected to the electrical timing means for starting the timing means to run the time interval upon operation of the detecting means whereby the valve opens upon expiration of the time interval permitting the bolt to retract;

means for sounding an alarm during the time interval to indicate that an attempt is being made to open the door, and emergency condition indicating means connected between the solenoid and power supply means for interrupting power to the solenoid upon the occurrence of an emergency condition.

18. A system for securing at least one emergency exit door of an enclosure while providing for emergency opening of the emergency exit door to provide egress from the enclosure, the system comprising:

securing means for preventing the door from opening when the securing means is in a first mode and for allowing the door to open when the securing means is in a second mode;

retaining means included with the securing means for retaining the securing means in the first mode;

releasing means connected to the retaining means and operating the retaining means for allowing the securing means to shift to the second mode;

electrical switch means for providing a signal indicating that an attempt to open the door is occurring;

electrical timing means connected to the electrical switch means and started by the signal from the electrical switch means to generate a release signal after a predetermined time interval, the electrical timing means being connected to the releasing means to thereby allow the securing means to shift from the first mode to the second mode;

emergency signalling means for indicating occurrence of an emergency condition, said emergency signalling means being connected to the retaining means for operating the retaining means to allow the shift of the securing means from the first to the second mode upon the occurrence of an emergency condition, and means for indicating that an attempt has been made to open the door.

19. The system of claim 18 wherein the securing means includes a bolt means and keeper means wherein the bolt means is projected behind the keeper means when the securing means is in the first mode and retractable from behind the keeper means when the securing means is in the second mode;

and wherein the electrical switch means includes:

operating means connecting the switch means to the bolt means.

20. The system of claim 19 further comprising throttling means for throttling a fluid, means for connecting the bolt means to the throttling means for delaying retraction of the bolt means upon an attempt to open the door, a valve means included with the retaining means, the throttling means being in parallel with the valve means, the valve means being opened by the releasing means whereby the valve means allows the fluid to bypass the throttling means upon generation of the release signal by the electrical timing means.

21. The system of claim 20 wherein the bolt means includes a cam surface for engaging the keeper means and mounting means for mounting the bolt means to retract upon application of a force between the bolt means and keeper means whereby the bolt means is retracted upon pressing against the door.

22. The system of claim 21 further including a toggle linkage connected to the bolt means and movable from a first configuration to a second configuration wherein when in the first configuration, the toggle linkage is blocked from collapsing thereby dogging the bolt means and preventing the bolt means from collapsing and when in the second configuration, the toggle linkage is not blocked from collapsing thereby undogging the bolt means and allowing the bolt means to retract.

23. The system of claim 22 including a panic bar extending across the door and having means thereon for engaging the toggle linkage to push the toggle linkage toward the second configuration whereby the toggle linkage collapses, and wherein the releasing means further includes abutment means for transferring force directly to the door after the toggle linkage has collapsed whereby pressure on the panic bar causes the keeper to urge the bolt means toward the retracted position.

24. The system of claim 18 further including means on the door for indicating whether the door is open or shut, wherein the securing means includes bolt means and wherein the electrical switch means includes means for monitoring the position of the bolt means to determine whether the bolt means is projected or retracted.

25. The system of claim 18 for securing a plurality of doors wherein each of the doors includes at least securing means and retaining means thereon, and wherein at least the timing means is displaced from the doors in a single circuit wherein a single timing circuit delays the shifting of the securing means on a plurality of doors from the first to the second mode.

26. The system of claim 25 further including on each of the doors means for indicating whether the doors are open or shut, wherein the securing means each include bolt means and separate electrical switch means for each bolt means which switch means each include means for monitoring the position of the bolt means to determine whether the bolt means are projected or retracted.

27. The system of claim 18 wherein the electrical timing means includes:

a first timer connected to the electrical switch means for providing an initiating signal after a predetermined delay in order to indicate that a serious attempt to open the door is occurring, and a second timer started by the signal of the first timer for emitting the release signal after a second predetermined interval.

28. The system of claim 27 wherein the first timer includes means for delaying the initiating signal for approximately three seconds, and the second timer includes means for delaying the release signal for approximately fifteen to thirty seconds.

29. The system of claim 27 wherein the timing means further includes:

a third timer connected to the second timer and to the retaining means for holding the securing means in the second mode for a predetermined interval and for thereafter permitting the securing means to return to the first mode.

30. The system of claim 29 wherein the first timer includes means for delaying the initiating signal for approximately three seconds, the second timer includes means for delaying the release signal for approximately fifteen to thirty seconds, and the third timer includes means for holding the securing means in the second mode for approximately ten seconds.

31. The system of claim 18 wherein the electrical timing means includes a timer for holding the securing means in the second mode for a predetermined interval after the release signal is generated and for thereafter permitting the securing means to return to the first mode.

* * * * *